US006226915B1

(12) United States Patent
Kotsiopoulos

(10) Patent No.: US 6,226,915 B1
(45) **Date of Patent: *May 8, 2001**

(54) FORWARD ANGLED GRIP FOR HAND-HELD WEAPONS AND THE LIKE

(76) Inventor: Thomas G. Kotsiopoulos, 804 Seton Ct., Wheeling, IL (US) 60090

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/047,806

(22) Filed: Mar. 25, 1998

(51) Int. Cl.[7] ..... F41C 23/10
(52) U.S. Cl. ..... 42/71.02; 124/31
(58) Field of Search ..... 42/7, 50, 1.14, 42/1.15, 71.02, 105, 52, 72, 1.16; 124/31, 36, 64, 65, 69; 89/1.42

(56) References Cited

U.S. PATENT DOCUMENTS

| | | | | |
|---|---|---|---|---|
| 118,886 | * | 9/1871 | Snow et al. | 124/69 |
| 1,180,439 | * | 4/1916 | Rudloff | 42/7 |
| 2,398,813 | | 4/1946 | Swisher | 273/369 |
| 2,433,309 | * | 12/1947 | Van Karner | 124/31 |
| 2,817,328 | | 12/1957 | Gale | 124/74 |
| 3,379,188 | * | 4/1968 | Walther | 124/69 |
| 3,572,310 | | 3/1971 | Chiba | 124/31 |
| 3,616,561 | * | 11/1971 | Hendricks | 42/1.14 |
| 4,271,623 | * | 6/1981 | Beretta | 42/72 |
| 4,616,622 | | 10/1986 | Milliman | 124/73 |
| 4,819,610 | | 4/1989 | Lacam et al. | 124/75 |
| 4,910,646 | * | 3/1990 | Kim | 124/36 |
| 4,932,148 | * | 6/1990 | Barrett | 89/1.42 |
| 4,936,282 | | 6/1990 | Dobbins et al. | 124/74 |
| 5,063,905 | | 11/1991 | Farrell | 124/72 |
| 5,224,465 | | 7/1993 | Milliman | 124/76 |
| 5,257,614 | | 11/1993 | Sullivan | 124/73 |
| 5,265,582 | | 11/1993 | Bhogal | 124/73 |
| 5,280,778 | * | 1/1994 | Kotsiopoulos | 124/73 |
| 5,349,938 | | 9/1994 | Farrell | 124/73 |
| 5,477,843 | | 12/1995 | Kunimoto | 124/73 |
| 5,494,024 | | 2/1996 | Scott | 124/73 |
| 5,505,188 | | 4/1996 | Williams | 124/74 |
| 5,509,399 | | 4/1996 | Poor | 124/76 |
| 5,515,838 | | 5/1996 | Anderson | 124/76 |
| 5,572,982 | | 11/1996 | Williams | 124/74 |
| 5,613,483 | | 3/1997 | Lukas et al. | 124/73 |

FOREIGN PATENT DOCUMENTS

| | | | | |
|---|---|---|---|---|
| 1958850 | * | 6/1971 | (DE) | 42/50 |
| 974865 | * | 2/1951 | (FR) | 42/72 |
| 571902 | * | 9/1945 | (GB) | 42/71.02 |
| 2160299 | * | 12/1985 | (GB) | 124/64 |
| 640161 | * | 5/1962 | (IT) | 42/1.14 |

* cited by examiner

*Primary Examiner*—Stephen M. Johnson
(74) *Attorney, Agent, or Firm*—Leydig, Voit & Mayer, Ltd.

(57) ABSTRACT

A hand-held firearm which affords improved hand manipulation is provided. The firearm includes a frame member and a longitudinally extending barrel having an open front end through which projectiles can be fired. The firearm further includes a pivotally mounted trigger and a handle which are also carried by the frame member. The handle being configured such that it is angled away from the axis perpendicular to the longitudinal axis of the barrel towards the front end of the barrel.

8 Claims, 2 Drawing Sheets

FIG. 1
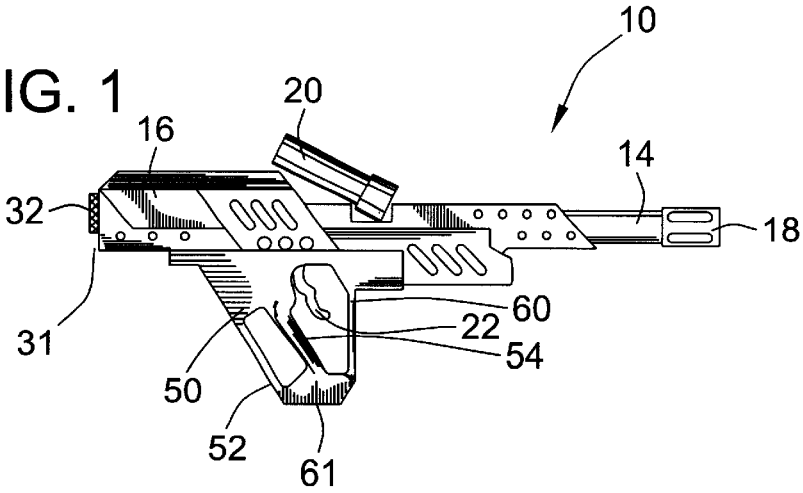
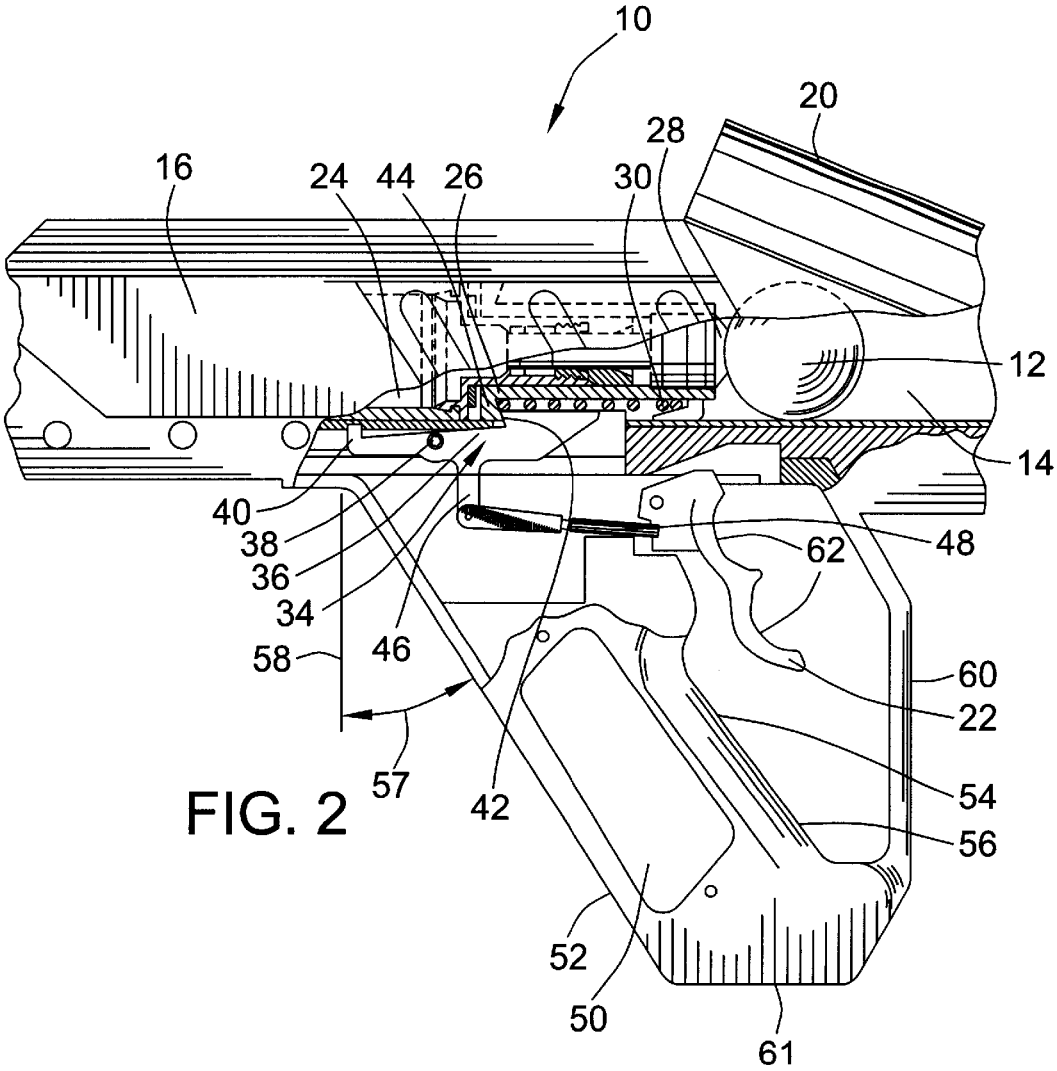
FIG. 2

FORWARD ANGLED GRIP FOR HAND-HELD WEAPONS AND THE LIKE

FIELD OF THE INVENTION

This invention generally relates to the weaponry art, and more particularly, to a forward-facing grip for improved manipulation of the weapon.

BACKGROUND OF THE INVENTION

A variety of different types of hand-held firearms exist such as conventional handguns and compressed gas powered guns. These firearms discharge a variety of different types of projectiles including, for example, bullets, pellets, and frangible marking projectiles sometimes referred to as "paint balls". Typically, a hand held firearm employs a longitudinally extending barrel, a frame member and a downwardly depending trigger arrangement.

Conventional hand-held firearms also have a downwardly extending handle or grip which is either angled toward the rear of the weapon (the end of the firearm opposite the open end of the barrel from which the projectile is expelled) or is perpendicular to the longitudinal axis of the barrel. One problem with conventional hand-held weapons having such handle arrangements is that their handles or grips can make them awkward to manipulate including to hold steady and to aim. For example, in order to optimize aiming of a hand-held weapon it is often desirable for a user to position the firearm as close as possible to his or her eyes. With conventional hand-held weapons, however, this requires a very awkward arm position which leads to uncomfortable and unstable positioning of the weapon with a resultant decrease in firing accuracy.

OBJECTS AND SUMMARY OF THE INVENTION

Accordingly, in view of the foregoing, it is an general object of the present invention to provide a hand-held weapon which provides improved hand manipulation.

Another object of the present invention is to provide a hand-held firearm which is easier to aim thereby enabling improved accuracy.

A further object of the present invention is to provide a hand-held weapon which allows for more natural, comfortable and steady firing positions as compared to conventional head-held firearms.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 1 is a side view of an illustrative compressed gas powered gun that utilizes the teachings of the present invention.

FIG. 2 is an enlarged partially cutaway side view of the compressed gas powered gun of FIG. 1.

Figure 3:
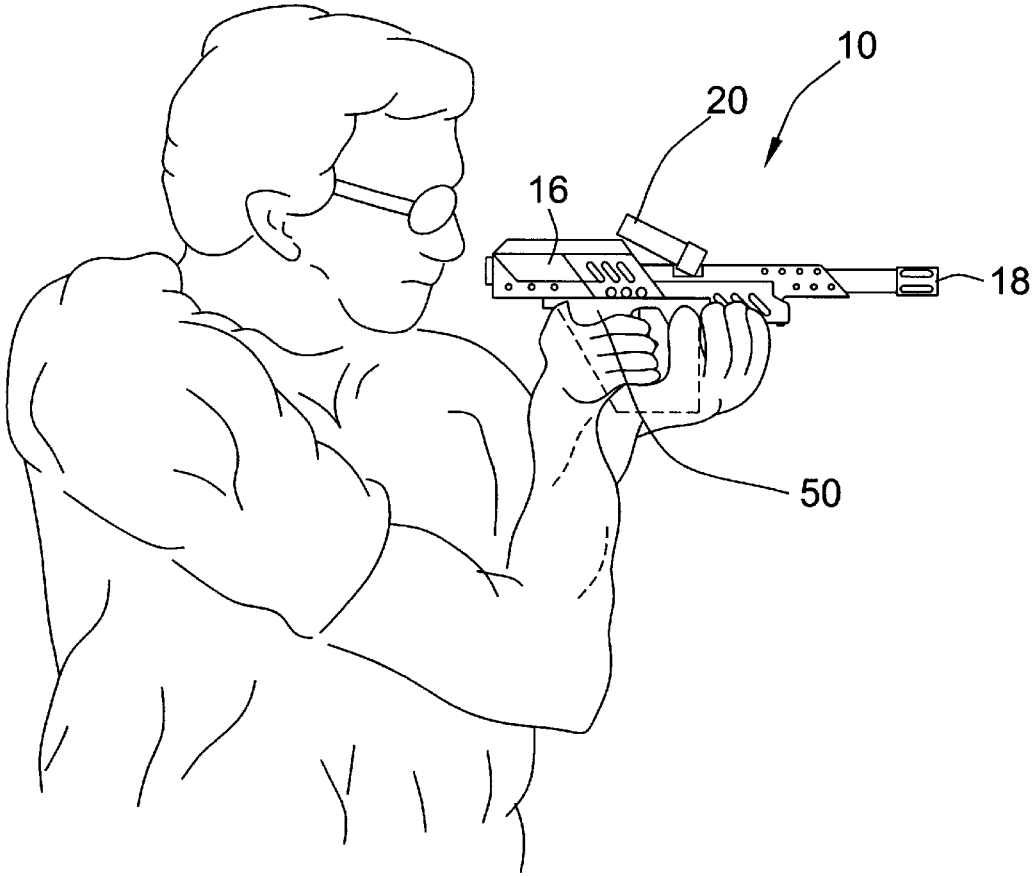
FIG. 3 is a side view showing one illustrative example of how a user may manipulate the compressed gas power gun of FIG. 1.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Referring now more particularly to FIG. 1 there is shown an illustrative embodiment of a hand-held firearm embodying the present invention. The illustrated firearm comprises a compressed gas powered marking pellet gun 10 which is sometimes also referred to as a "paint ball" gun. The gun fires relatively fragile projectiles 12, sometimes referred to as "paint balls" which have a frangible shell that is filled with a marking composition. These projectiles are designed to break upon impact with an object and thereby discharge the marking composition onto the object. While the present invention is described in connection with a compressed gas powered paint ball gun, it will be readily appreciated by those skilled in the art that the teachings of the present invention can be applied to any type of hand-held gun, firearm or weapon which discharges a projectile.

For directing the projectile when it is fired, the gun 10 includes an elongate, longitudinally extending generally cylindrical barrel 14. The barrel 14 is carried by a longitudinally extending frame member 16 and has an open front end 18 through which the projectile 12 is expelled when the gun 10 is fired. To feed a supply of projectiles 12 to the gun 10, an ammunition feeding tube 20 is provided on the frame member 16 which feeds a plurality of projectiles to the gun, one at a time, as will be understood by those skilled in the art. The frame member 16 also carries, in this instance, an air inlet (not shown) to which a compressed gas source such as an air line, hose, canister or the like can be connected so as to supply compressed gas to the gun. The gun is fired via actuation of a pivotally mounted trigger 22 which depends downwardly from the frame member 16.

For propelling the projectiles 12, the gun 10 includes a firing mechanism or system. The firing system, in the illustrated embodiment, generally comprises a pressure regulating assembly which operates to control the pressure of the compressed gas received from the compressed gas source and a firing chamber 24 (FIG. 2) which stores the compressed gas that is used to propel the projectile 12. The firing system also includes various fluid passageways which interconnect the regulating assembly and the firing chamber 24. As will be appreciated by those skilled in the art, the firing system is operable in a firing mode wherein a projectile is expelled from the gun 10 and a ready-to-fire or reloading mode which places the gun in condition for firing. Upon actuation of an actuating bolt 26 which includes a power piston 28, the blast of compressed gas exits the firing chamber 24 and thereby propels the projectile 12. Once the compressed gas in the firing chamber 24 is released, a recoil spring 30 drives the actuating bolt 26 rearwardly against a bumper where it is held in place by the force of the recoil spring. The pressure to which the firing chamber 24 is charged, and thereby the velocity of the projectile 12, can be adjusted via a threaded velocity nut 32 provided on the rear end 31 of the frame member 16 of the gun. In order to allow the firing chamber 24 to charge at very nearly the full line pressure of the compressed gas source and thereby fill much more rapidly, the firing system may be configured as disclosed in co-pending U.S. Application Ser. No. 08/955,187, filed Oct. 21, 1997 which is incorporated herein by reference. Alternatively, the firing system may be configured as disclosed in U.S. Pat. No. 5,280,778 which is also incorporated herein by reference.

For actuating the firing mechanism, the gun 10 includes a trigger mechanism. As described in detail in said U.S. Pat. No. 5,280,778 and said U.S. Application Ser. No. 08/955,187, the actuating bolt 26 is maintained in a ready-to-fire position with the use of a trigger mechanism which includes a sear 34 having an arm 36 that is rotatable about a pivot 38, which in a preferred embodiment comprises a threaded roller bearing axle. The arm 36 has a transversely extending actuating member 40 at one end, located on one side of pivot 38, and an interlocking element 42 at the other end, located on the opposite side of the pivot 38. The actuating member

40 is generally aligned with an on/off flow valve (not shown) which is part of the firing system. The interlocking element 42 includes a notched portion that engages a dog portion 44 of the actuating bolt 26 in the ready-to-fire position. An actuating lever 46 projects transversely on the side of the latch arm 36 opposite the actuating member 40 and the interlocking element 42. A sliding trigger arm 48 disposed operates to transmit force from the trigger 22 to the actuating lever 46. As explained in detail in said U.S. Pat. No 5,280,778, this provides for semi-automatic firing of the gun 10 in operation. In order to allow provide the sensation of a "reactive trigger" which "pushes" the finger of a user after the gun is fired through the execution of a pull stroke of the trigger thereby helping a user achieve a faster firing rate, the trigger mechanism may be configured as disclosed in co-pending U.S. Application Ser. No. 08/955,047, filed Oct. 21, 1997 which is incorporated herein by reference.

In accordance with an important aspect of the present invention, the gun 10 has a forward-angled handle 50 which affords improved hand manipulation of the gun. In particular, as shown best shown in FIGS. 12, the handle 50 depends downwardly from the frame member 16 adjacent the trigger 22 and is angled forward away from a perpendicular orientation with respect to the longitudinal axis of the barrel 14 towards the front end 18 of the barrel. The handle 50 has a generally flat rear face 52 and a forward face 54 which includes a hand grip 56. In the illustrated embodiment, the handle 50 is angled forward (the forward angle is referenced as 57) approximately 30° from vertical which herein is defined as the axis 58 perpendicular to the longitudinal axis of the barrel 14 as shown in FIG. 2. The handle 50 further includes an enlarged trigger guard 60 which depends downwardly from the frame member 16. The trigger guard 60 extends from the frame member 16 to the lower end 61 of the handle and as such not only surrounds the trigger 22 but also the forward face 54 of the handle such that a user may insert all of his or her fingers in the trigger guard 60 when manipulating the gun 10. As best shown in FIG. 2, the trigger 22 has two finger grooves 62 which enable a user to utilize two fingers to pull the trigger if desired.

The forward angled configuration of the handle 50 of the present invention enables much more comfortable and ergometrically correct manipulation of the gun 10 as compared to conventional handle arrangements. For example, it is known that a hand-held weapon is easier to aim when it is positioned closer to a user's face and eyes. As shown in FIG. 3, the handle arrangement of the present invention enables a user to achieve a much more stable and comfortable firing position when the gun is arranged close to the user's eyes for improved aiming.

In particular, when a user attempts to bring a gun having a conventional rearward angled or vertical handle closer to his body, the user must bend his wrist of the arm holding the gun handle at an awkward angle. Additionally, the user must move his elbow away from his body. The result is a very awkward, uncomfortable and unsteady firing position which leads to a decrease in firing accuracy. Thus, hand-held guns or weapons which have a conventional handle arrangement must be held away from the user's body, however, this makes it more difficult to aim the gun. In sharp contrast, the forward angled handle 50 of the present invention enables a user to maintain a much more natural, and thus comfortable and steady, wrist angle when the gun 10 is positioned close to the body, including the eyes and face, in order to improve aiming. Moreover, the user can keep his elbow tucked tight to his body and thus can hold the gun much more steady.

From the foregoing it can be seen that the forward angled handle 50 utilized on the hand-held gun of the present invention enables the user to hold the gun much more comfortably and steady when the gun is positioned closer to his eyes. This enables the user to achieve greater firing accuracy than what is possible with guns having conventional handle arrangements which must be held a distance away from a user's eyes and body in order to have a comfortable and steady firing position.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. A hand-held gun for propelling a projectile comprising:

a frame member, a longitudinally extending barrel supported by the frame member having an open front end through which the projectile can be discharged, a firing mechanism for actuating discharge of the projectile which includes a trigger which is carried by the frame member, wherein the firing mechanism utilizes compressed gas to propel the projectile, and a handle carried by the frame member adjacent the trigger for gripping by a trigger-actuating hand of a user, the handle extending away from the frame member towards the front end of the barrel and the trigger and defining a hand grip portion having a front face and a rear face each of which is angled toward the front end of the barrel and the trigger.

2. The hand-held gun of claim 1 further including a trigger guard which extends from the frame member to a lower end of the handle.

3. The hand-held gun of claim 1 wherein the trigger has a plurality of finger grooves therein each of which is sized and configured to receive a finger of a user.

4. The hand-held gun of claim 1 wherein the front face and rear face of the hand grip portion of the handle each extend at an angle of approximately 60° with a longitudinal axis of the barrel toward the front end of the barrel.

5. A hand-held gun for propelling a projectile, comprising:

a frame member a longitudinally extending barrel supported by the frame member having a longitudinal barrel axis and an open front end through which the projectile can be discharged, a firing mechanism for actuating the discharge of the projectile including a trigger which is carried by the frame member, wherein the firing mechanism utilizes compressed gas to propel the projectile, and a handle carried by the frame member adjacent the trigger for gripping by a trigger-actuating hand of a user, the handle extending away from the frame member and defining a hand grip portion which has a front face and a rear face each of which extends at an acute angle relative to the barrel axis toward the front end of the barrel and the trigger.

6. The hand-held gun of claim 5 further including a trigger guard which extends from the frame member to a lower end of the handle.

7. The hand-held gun of claim 5 wherein the trigger has a plurality of finger grooves therein each of which is sized and configured to receive a finger of a user.

8. The hand-held gun of claim 5 wherein the front face and rear face of the hand grip portion of the handle each extend at an angle of approximately 60° relative to the barrel axis.

* * * * *